US005613366A

United States Patent [19]

Schoenman

[11] Patent Number: 5,613,366

[45] Date of Patent: Mar. 25, 1997

[54] SYSTEM AND METHOD FOR REGULATING THE TEMPERATURE OF CRYOGENIC LIQUIDS

[75] Inventor: Leonard Schoenman, Citrus Heights, Calif.

[73] Assignee: Aerojet General Corporation, Sacramento, Calif.

[21] Appl. No.: 451,092

[22] Filed: May 25, 1995

[51] Int. Cl.[6] ..... F17C 3/10

[52] U.S. Cl. ..... 62/45.1; 62/48.3; 62/51.1; 62/DIG. 13

[58] Field of Search ..... 62/45.1, 48.3, 62/51.1, DIG. 13

[56] References Cited

U.S. PATENT DOCUMENTS

| | | | |
|---|---|---|---|
| 2,593,916 | 4/1952 | Peff | 62/DIG. 13 X |
| 2,897,657 | 8/1959 | Rupp | 62/DIG. 13 X |
| 3,374,641 | 3/1968 | Corvino et al. | 62/45.1 |
| 3,659,543 | 5/1972 | Basile et al. . | |
| 3,699,696 | 10/1972 | Rhoton | 62/45.1 |
| 3,762,175 | 10/1973 | Jones . | |
| 3,782,128 | 1/1974 | Hampton et al. . | |
| 3,791,164 | 2/1974 | Laverman . | |
| 3,930,375 | 1/1976 | Hoffman . | |
| 3,942,331 | 3/1976 | Newman, Jr. et al. | 62/45.1 |
| 4,027,379 | 6/1977 | Cheng et al. | 62/DIG. 13 X |
| 4,140,073 | 2/1979 | Androulakis . | |
| 4,145,892 | 3/1979 | Skakunor et al. | 62/45.1 |
| 4,365,478 | 12/1982 | Stori et al. . | |
| 4,386,309 | 5/1983 | Peschka . | |
| 4,715,186 | 12/1987 | Ishimaru et al. . | |
| 4,897,226 | 1/1990 | Hoyle et al. . | |
| 5,005,362 | 4/1991 | Weltmer, Jr. et al. | 62/45.1 |
| 5,160,769 | 11/1992 | Garrett . | |
| 5,375,423 | 12/1994 | Delatte | 62/45.1 |
| 5,386,706 | 2/1995 | Bergsten et al. | 62/45.1 |
| 5,408,832 | 4/1995 | Boffito et al. | 62/45.1 |

FOREIGN PATENT DOCUMENTS

| | | |
|---|---|---|
| 1286340 | 2/1962 | France . |

*Primary Examiner*—Christopher Kilner
*Attorney, Agent, or Firm*—Townsend and Townsend and Crew, LLP

[57] ABSTRACT

A relatively inexpensive system and method for regulating the temperature of a cryogenic liquid in a storage vessel (2), such as vehicle refueling station, comprises inner and outer walls (6, 8) defining a inner chamber (12) for housing the cryogenic liquid. To provide a variable thermal resistance around the inner chamber, a thermal control fluid is disposed within an insulation space (10) between the inner and outer walls. A fluid conduit (30) has an inlet and outlet in fluid communication with the chamber and a heat exchanger coil (36) disposed within the insulation space. A control valve (38) allows the cryogenic liquid to flow through the fluid conduit so that the cryogenic liquid is in heat exchange relationship with the thermal control gas as the liquid passes through the coil (i.e., the cryogenic liquid cools and condenses the thermal control gas to reduce the control gas pressure). The pressure of the control gas within the insulation space can be modulated to thereby control the heat flow into the inner chamber by controlling the flow rate of the cryogenic liquid through the fluid conduit.

21 Claims, 2 Drawing Sheets

SYSTEM AND METHOD FOR REGULATING THE TEMPERATURE OF CRYOGENIC LIQUIDS

FIELD OF THE INVENTION

This invention relates to storage vessels for cryogenic liquids generally, and more specifically to a system and method for regulating the temperature and pressure of cryogenic liquids in a thermally insulated, double wall storage vessel, such as an LNG vehicle refueling station.

BACKGROUND OF THE INVENTION

Cryogenic liquids are liquified gases that have a very low critical temperature (e.g., −200° F. or less), such as nitrogen, natural gas or gaseous hydrocarbons. Cryogenic liquids are typically stored or transported in vessels having a double wall vacuum jacketed construction with a multi-layer foil insulation in the vacuum space between the walls. A disadvantage of this type of multi-layer insulation is that it generally has a fixed thermal resistance. Thus, when liquid is drawn from a vessel of this type, the volume of liquid drawn must be replaced by an equal volume of gas in order to maintain the pressure in the vessel. Otherwise, the pressure of the cryogenic liquid inside the chamber will decrease, causing some of the liquid to flash to gas. Flash evaporation of the liquid reduces its temperature causing the pressure in the tank to decrease. A typical method of replacing the liquid volume removed with an equal gas volume involves directing some additional liquid drawn from the vessel through an external heat exchanger. The liquid is vaporized into a larger volume of gas in the heat exchanger and then fed back into the vessel by either a pump or gravity.

Another disadvantage of existing storage vessels is that the multi-layer foil insulation is very costly to manufacture. The heat exchanger system adds to this cost. While the cost may not be prohibitive for vessels in which the cryogenic liquid is stored for long periods of time, such as cargo ships, other applications, such as vehicle refueling stations, entail a rapid dispensing and replacement of the cryogenic liquid. In these other applications, the manufacturing and operating costs of existing insulation systems cannot be justified.

SUMMARY OF THE INVENTION

The present invention is directed to a relatively inexpensive system and method for regulating the temperature and pressure of a liquified gas or cryogenic liquid in a storage vessel. The system provides a sufficient thermal barrier to maintain the cryogenic liquid below its critical temperature within the storage vessel. In addition, the system has a variable thermal resistance so that the pressure and temperature of the cryogenic liquid can be maintained above a desired level as large amounts of the liquid are drawn from the vessel, thereby facilitating delivery of the liquid.

The storage vessel of the present invention comprises inner and outer walls with the inner wall surrounding a chamber for holding the cryogenic liquid. To insulate the cryogenic liquid, a thermal control fluid, generally in the form of a gas, is retained in an insulation space between the inner and outer walls at reduced pressure. The heat flow through the thermal control gas to the cryogenic fluid is generally proportional to the control gas pressure. The storage vessel further includes a fluid conduit with an inlet and outlet in fluid communication with the chamber and a heat exchanger coil disposed within the insulation space. A control valve allows the cryogenic liquid to flow through the fluid conduit so that the cryogenic liquid is in heat exchange relationship with the thermal control gas as the liquid passes through the coil. The cryogenic liquid can cool and condense the thermal control gas to thereby reduce the control gas pressure. The pressure of the control gas within the insulation space can, therefore, be modulated by controlling the flow rate of the cryogenic liquid through the fluid conduit.

The storage vessel further includes an outlet for discharging the cryogenic liquid for use. As the cryogenic liquid is being drawn from the storage vessel, it is generally desirable to have a low thermal resistance in the insulation space so that the temperature of the inner chamber does not drop as the liquid is withdrawn. Low thermal resistance is achieved by a relatively low rate of circulation through the coil, which minimizes the cooling effect of the coil, allowing the pressure and temperature of the thermal control gas to rise by drawing heat from the atmosphere. When little or no liquid is being drawn from the storage vessel, a high thermal resistance is desirable to maintain the critical temperature of the cryogenic liquid. This is achieved by increasing the circulation rate through the fluid conduit, thereby keeping more of the thermal control gas in a low pressure condensed liquid phase to provide a more effective thermal barrier around the inner chamber.

One of the advantages of the present invention is that the thermal control gas is an inexpensive thermal barrier relative to other known insulation systems for cryogenic liquids, such as the multi-layer foil insulation discussed above. Another advantage is that the invention provides a variable thermal resistance in the insulation space to facilitate control of the temperature and pressure of the cryogenic liquid in the storage vessel. The invention is particularly advantageous in applications where large volumes of the cryogenic liquid are often dispensed from the storage vessel, such as vehicle refueling stations. In these applications, the liquid remains in the vessel for short periods of time and, therefore, costly insulation systems are not justified. In addition, when a large amount of cryogenic liquid is withdrawn from the storage vessel, the inner chamber will undergo a relatively large drop in pressure and temperature. Utilizing the method of the present invention, a low circulation rate of the cryogenic liquid through the coil can be selected so that the temperature of the thermal control gas increases, thereby increasing the heat flow into the chamber to offset the temperature drop caused by the withdrawal of the liquid.

Other features and advantages of the invention will appear from the following description in which the preferred embodiment has been set forth in detail in conjunction with the accompanying drawings.

DESCRIPTION OF THE PREFERRED EMBODIMENTS

Figure 1:
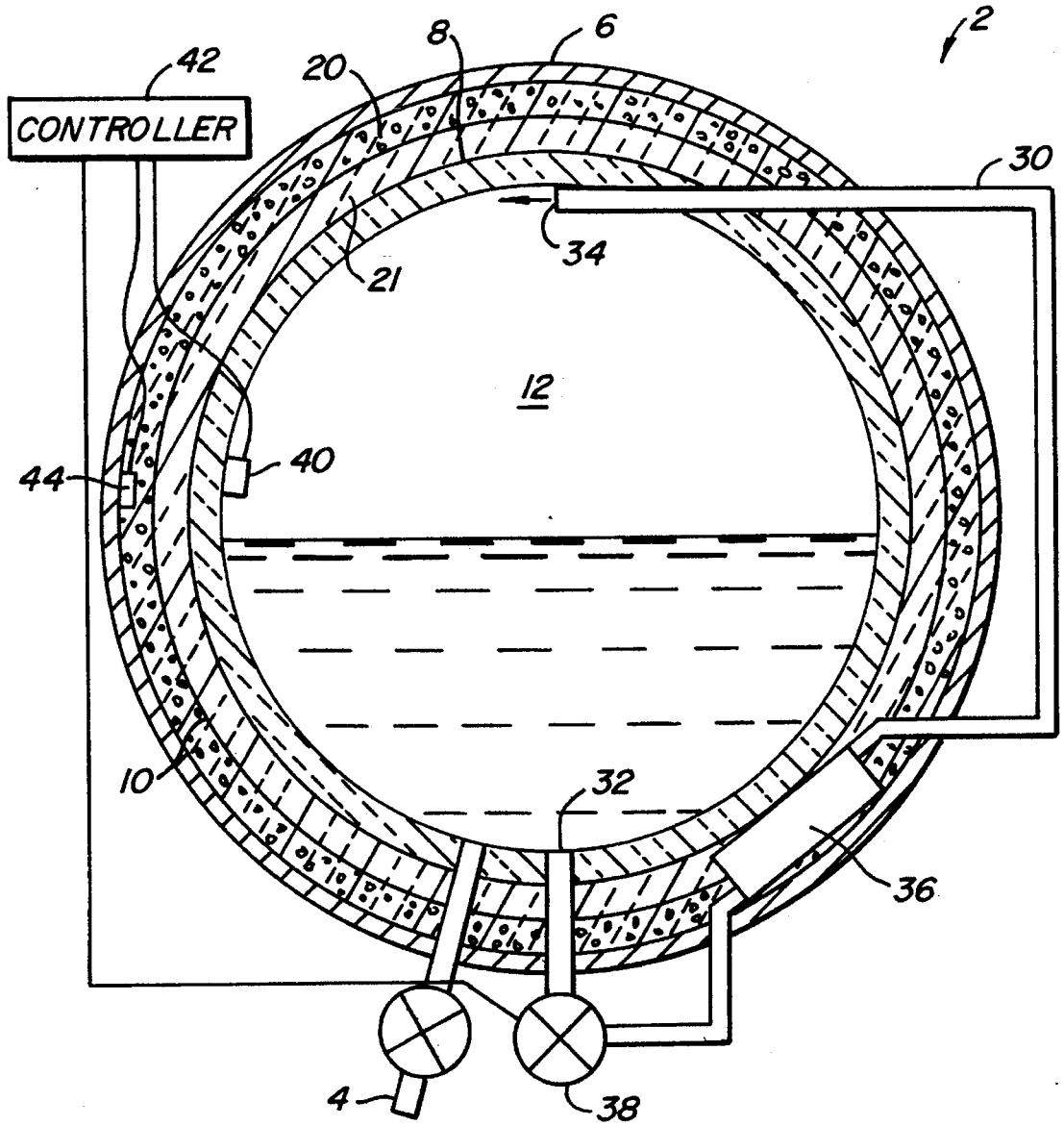
FIG. 1 is a schematic cross-sectional view of a storage vessel in accordance with the principles of the present invention.

Referring to the drawings in detail, wherein like numerals indicate like elements, a storage vessel 2 is illustrated according to the principles of the invention. Storage vessel 2 may, for example, be used as a vehicle refueling station with an outlet 4 for discharging liquid natural gas. Other applications for storage vessel 2 include long or short term storage and/or transportation of nitrogen, carbon dioxide, helium, LPG's (liquified petroleum gas) or other cryogenic liquids.

As shown in FIG. 1, storage vessel 2 includes an outer wall 6 and an inner wall 8 defining an insulation space 10 therebetween. Inner wall 8 defines an inner chamber 12 for housing the cryogenic liquid and is formed of a suitable metal or composite material for use at low temperatures. Inner and outer walls 6, 8 are both spherical in this embodiment, as is the inner chamber 12. However, it should be understood that walls 6, 8 may be cylindrical or have a variety of other cross-sectional shapes, such as square, rectangular, oval, etc., if desired. Storage vessel 2 further includes a support structure (not shown) for maintaining the spacing between inner and outer walls 6, 8 and for supporting outer wall 6 above or below the ground.

To provide a variable thermal barrier around inner chamber 12, insulation space 10 includes both open cell and closed cell insulation 20, 21 and a thermal control fluid disposed within the open spaces of the open cell insulation 20. Open cell insulation 20 allows transport of the thermal control gas to the heat exchanger surfaces (discussed below) and preferably comprises perlite. Closed cell insulation 21 is preferably a material that will prevent condensation of the thermal control fluid on the outer surface of inner wall 6, such as polystyrene foam. Alternatively, a membrane vapor barrier (not shown) may be employed between the open and closed cell insulation 20, 21 to inhibit condensation of the thermal control fluid on inner wall 6.

The thermal control fluid may be a single fluid or a mixture of fluids that have a relatively low thermal conductivity to facilitate insulation of the cryogenic liquid. In addition, the thermal control fluid is selected to have specific temperature and pressure dependent characteristics so that insulation space 10 will have a variable thermal resistance depending on the temperature and/or pressure of the thermal control fluid. Preferably, the fluid has a phase change property (solid to vapor or liquid to vapor) such that, under a specific range of temperatures, the volume of the fluid undergoes a relatively large increase whereby the pressure is increased by an incremental amount (and vice versa). With this configuration, the thermal barrier around chamber 12 can be modulated by controlling the temperature and, therefore, the pressure of the thermal control fluid, as discussed in further detail below.

Figure 2:
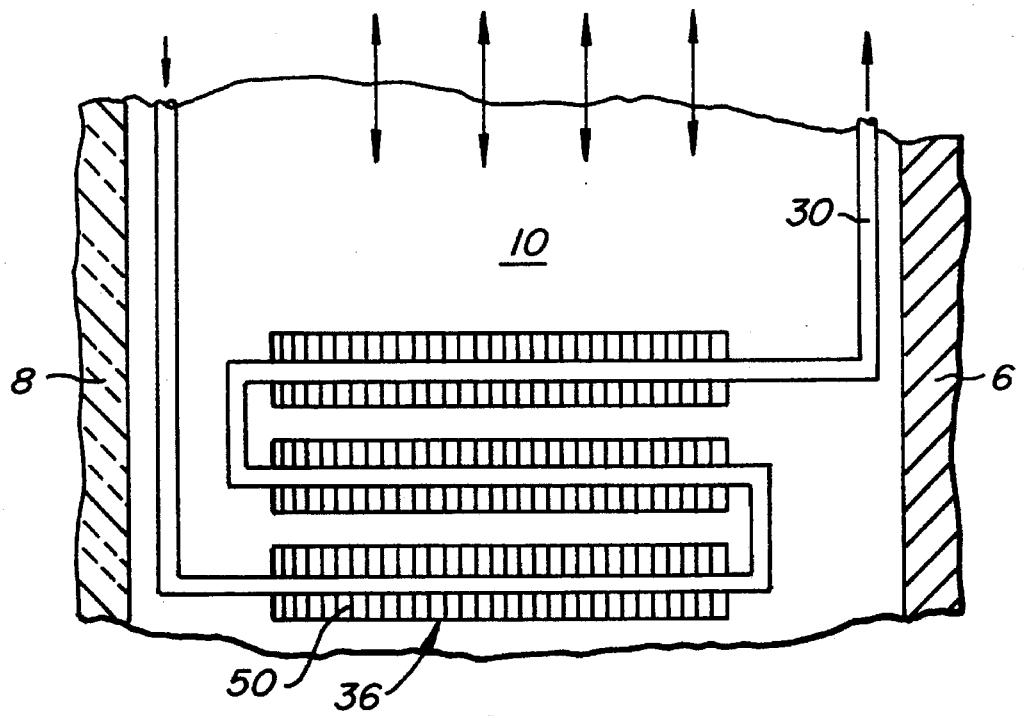
FIG. 2 is an enlarged view of a heat exchanger disposed within an insulation space of the storage vessel of FIG. 1.

In the preferred embodiment of FIGS. 1 and 2, the thermal control fluid will be in the liquid phase at a temperature substantially equivalent to the temperature that the cryogenic liquid is stored within storage vessel 2. The thermal control fluid will evaporate into a gas at temperatures slightly higher than the temperature of the cryogenic liquid. Preferably, this fluid is nitrogen, which has a conductivity of about 0.013 Btu/hr-ft-°F. ($5.68\times10^{-4}$ g- cal/s-cm$^2$ (°c/cm)) and a boiling temperature of −320° F. (−160° C.) at a pressure of 1 Atmosphere. However, a variety of gases may be used depending on various factors, such as the type of closed cell insulation used, the cryogenic liquid being stored within the vessel, etc. The following is a non-limiting list of gases that may be used as a thermal control fluid: helium, methane, air, carbon dioxide, argon and krypton.

As shown in FIG. 1, storage vessel 2 further includes a fluid conduit 30, such as a pipe, having an outlet 32 in communication with the bottom of inner chamber 12 and an inlet 34 in communication with the top of inner chamber 12. Fluid conduit 30 extends through a heat exchanger coil 36 located within insulation space 10. A control valve 38 is mounted to fluid conduit 30 between outlet 32 and heat exchanger coil 36. Control valve 38 is preferably a conventional variable valve that can be adjusted to vary the cross-sectional area of fluid conduit 30 and thereby regulate the flow rate of the cryogenic liquid through conduit 30. As discussed below, the cryogenic liquid will be automatically drawn through outlet 32 when fluid conduit 30 is open because the liquid turns into a vapor downstream of heat exchanger coil 36. The lower density of the vapor will create a pressure differential that draws the cryogenic fluid from outlet 32 to inlet 34.

Storage vessel 2 includes a means for automatically controlling the flow rate of cryogenic liquid through fluid conduit 30 depending on the pressure of the liquid within inner chamber 12. In the preferred configuration, the control means includes a sensor 40, such as a pressure gauge, disposed within inner chamber 12 and operatively coupled to a controller 42, such as a microprocessor. Controller 42 is coupled to an electromechanical device (not shown) adapted to open and close valve 38 based on signals from the microprocessor. A second sensor 44 may also be disposed within insulation space 10 to monitor the pressure or temperature of the thermal control fluid.

As shown in FIG. 2, heat exchanger coil 36 is preferably a high surface area fin tube heat exchanger comprising a plurality of fin coils 50 extending around fluid conduit 30 within insulation space 10. As cryogenic liquid passes through fin coils 50, the thermal control fluid delivers heat to the cryogenic liquid, causing it to evaporate into a cryogenic vapor. The thermal control fluid, in turn, condenses or solidifies around fin coils 50 so that the overall temperature and pressure within insulation space 10 is reduced.

Referring again to FIG. 1, the cryogenic liquid will generally be stored within inner chamber 12 for a short period of time before it is dispensed. To maintain the desired storage temperature of the liquid during this time, control valve 38 is opened so that a portion of the cryogenic liquid passes through fluid conduit 30 from inlet 32 to outlet 34. As the cold liquid passes through heat exchanger coil 36, it transfers heat to the thermal control fluid within insulation space 10. When this occurs, the cryogenic liquid will evaporate into cryogenic vapor and the thermal control fluid will condense within fin coils 50. The cryogenic vapor passes through outlet 32 back into inner chamber 12. Since the vapor returning to the top of the vessel is at a lower pressure than the cryogenic liquid at the bottom of inner chamber 12 due to the gravity head, the liquid will be withdrawn through fluid conduit 30 as long as control valve remains open. The condensation of thermal control fluid causes a decrease in the temperature and pressure within insulation space 10 and, therefore, a decrease in the thermal resistance of the space. This provides a sufficient thermal barrier around the cryogenic liquid within inner chamber 12 to ensure that it is maintained below its critical temperature.

When a large volume of the cryogenic liquid is dispensed through outlet 4 of storage vessel 2, the pressure within inner chamber 12 may suddenly drop causing the temperature of the cryogenic liquid within the chamber to decrease. When this occurs, sensor 40 detects the pressure drop and controller 42 partially or completely closes control valve 38 to slow down or stop the flow of the cryogenic liquid through fluid conduit 30. Since the cold liquid is no longer flowing through heat exchanger coil 36, the thermal control fluid rises in temperature and evaporates, thereby increasing the pressure within insulation space 10. The higher pressure within insulation space 10 causes the heat flow into inner chamber 12 to increase, thereby offsetting the temperature and pressure drop caused by the withdrawal of the liquid.

Figure 3:
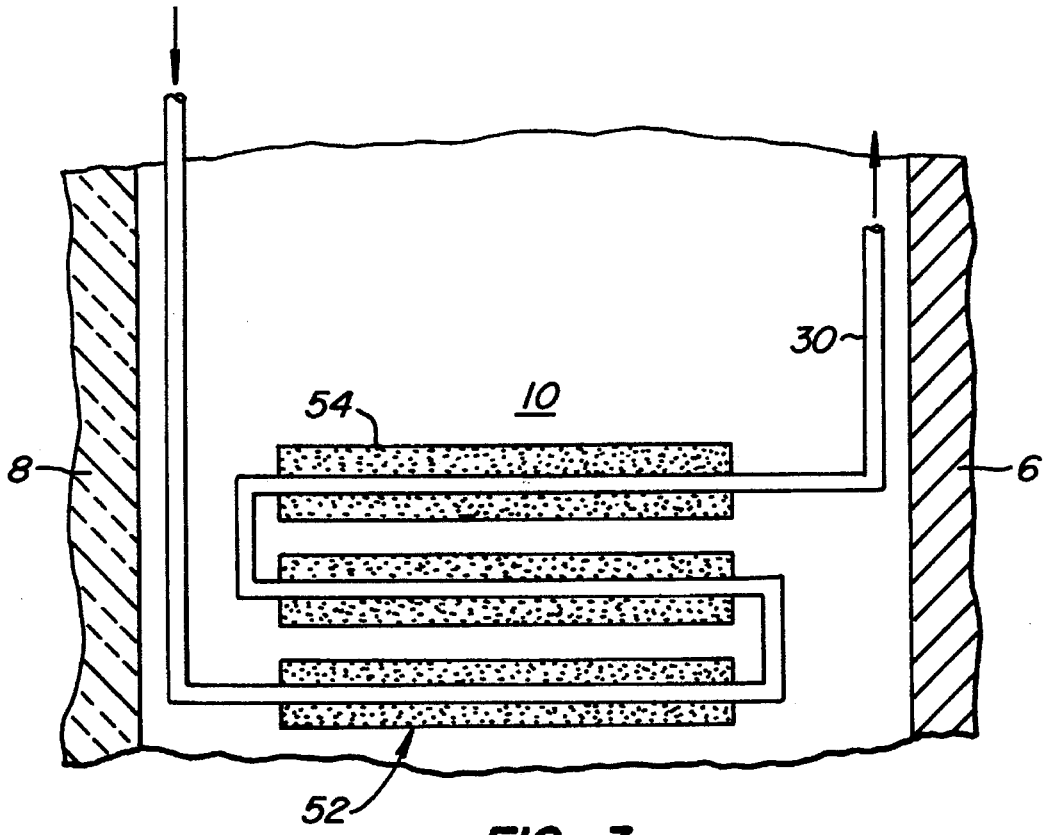
FIG. 3 is an enlarged view of an alternative embodiment of the heat exchanger of FIG. 2.

FIG. 3 illustrates an alternative embodiment of the present invention. In this embodiment, heat exchanger coil 52 is filled with a solid or liquid material 54 that will dissolve or adsorb a fluid depending on the temperature of the fluid. Preferably, material 54 is Saran™charcoal with fluid sorbates such as krypton, argon or nitrogen. However, it will be readily recognized by those skilled in the art that other solid or liquid materials may be used, such as hydrides. In this embodiment, the thermal control fluid is preferably a gas that will be adsorbed or dissolved into material 54 at temperatures substantially equal to the temperature of the cryogenic liquid and will be desorbed at temperatures slightly higher than the cryogenic liquid. Thus, when the cryogenic liquid is flowing through fluid conduit 30 at a relatively high rate, the thermal control gas will be adsorbed onto material 54 so that the pressure within insulation space 12 decreases. Likewise, when the flow rate of the cryogenic liquid is low or zero, the thermal control fluid will be desorbed from material 44 so that the pressure of insulation space 12 increases.

The above is a detailed description of various embodiments of the invention. Departures from the disclosed embodiments may be made which are still within the scope of the invention and obvious modifications will occur to a person skilled in the art. The full scope of the invention is set out in the claims that follow and their equivalents.

What is claimed is:

1. A storage vessel for storing a liquified gas comprising:

inner and outer walls defining a space therebetween, the inner wall further defining a chamber, the liquified gas being retained within the chamber;

a thermal control fluid disposed within the space for modulating heat flow to the liquified gas;

a fluid conduit having an inlet and an outlet in fluid communication with the chamber, the fluid conduit passing through the space and defining a heat transfer portion within the space; and a control valve for controlling flow of the liquified gas through the fluid conduit, the liquified gas being in heat exchange relationship with the thermal control fluid when the liquified gas passes through the heat transfer portion of the fluid conduit.

2. The storage vessel of claim 1 wherein the heat transfer portion is a heat exchanger coil positioned within the space.

3. The vessel of claim 2 further including a solid adsorbent disposed adjacent the heat exchanger coil, the thermal control fluid being adsorbed onto the solid adsorbent upon cooling.

4. The vessel of claim 2 further including a solid adsorbent disposed adjacent the heat exchanger coil, the thermal control fluid being adsorbed onto the solid adsorbent upon condensation.

5. The vessel of claim 3 wherein the solid adsorbent is a bed of particles disposed around the heat exchanger coil.

6. The vessel of claim 1 wherein the fluid conduit inlet is positioned below the fluid conduit outlet.

7. The vessel of claim 2 wherein the chamber has an outlet for discharging a portion of the liquified gas.

8. The vessel of claim 7 further including a sensor for detecting the pressure within the chamber and control means, operatively coupled to the control valve and the sensor, for controlling a flow rate of the liquified gas through the control valve so that the temperature of the liquified gas within the chamber remains substantially the same.

9. The vessel of claim 8 wherein the control means comprises means for decreasing the flow rate of the liquified gas when the pressure within the chamber decreases to increase the temperature of the thermal control fluid, thereby allowing more heat to pass through the inner wall such that the temperature of the liquified gas within the chamber remains substantially the same.

10. The vessel of claim 8 wherein the control means comprises means for increasing the flow rate of the liquified gas when the pressure within the chamber increases to decrease the temperature of the thermal control fluid, thereby allowing less heat to pass through the inner wall such that the temperature of the liquified gas within the chamber remains substantially the same.

11. The vessel of claim 8 wherein the control means comprises means for adjusting the control valve to vary a cross-sectional area of the flow conduit, the vapor downstream of the heat exchanger coil creating a low pressure region that draws the liquified gas from the chamber into the fluid conduit.

12. The vessel of claim 1 further including a closed cell insulation disposed within the space, the closed cell insulation and the thermal control fluid creating a thermal barrier that substantially surrounds the liquified gas within the chamber, the closed cell insulation inhibiting the thermal control fluid from condensing on the inner wall.

13. The vessel of claim 1 further including an open cell insulation and a membrane vapor barrier within said space, the vapor barrier being disposed around said inner wall to inhibit the thermal control fluid from condensing on the inner wall, the open cell insulation and the thermal control fluid creating a thermal barrier that substantially surrounds the liquified gas within the chamber.

14. A method for regulating temperature in a liquified gas comprising:

(a) placing said liquified gas in a storage vessel with inner and outer walls and a space therebetween, the inner wall defining a chamber, the liquified gas being placed within the chamber;

(b) thermally insulating the liquified gas with a thermal control fluid disposed within the space; and (c) directing a portion of the liquified gas at a controlled flow rate through a fluid conduit having a heat transfer portion within the space to thereby cool said thermal control fluid with said liquified gas to a controlled degree.

15. The method of claim 14 further comprising evaporating said portion of the liquified gas into a vapor during (c), and returning the vapor to the chamber.

16. The method of claim 15 wherein (c) comprises adjusting a control valve to vary a cross-sectional area of the flow conduit and creating a low pressure region downstream of the heat exchanger portion to draw the liquified gas into the fluid conduit.

17. The method of claim 15 wherein (c) comprises directing the liquified gas through a heat exchanger coil and condensing the thermal control fluid into a thermal control liquid when the thermal control fluid reaches a temperature substantially equivalent to the temperature of said portion of liquified gas.

18. The method of claim 15 wherein (d) includes adsorbing the thermal control fluid onto a solid material disposed near the heat exchange portion of the fluid conduit when the thermal control fluid reaches a temperature substantially equivalent to the temperature of said portion of liquified gas.

19. The method of claim 14 further including discharging a portion of the liquified gas through an outlet in the storage vessel to reduce pressure within the chamber and thereby cool the liquified gas within the chamber.

20. The method of claim 19 further including decreasing the flow rate of the liquified gas through the fluid conduit when the pressure within the chamber is decreased to increase the temperature and pressure of the thermal control fluid, thereby allowing more heat to pass through the inner wall such that the temperature of the liquified gas within the chamber remains substantially the same.

21. The method of claim 19 further including increasing the flow rate of the liquified gas through the fluid conduit when the pressure within the chamber is increased to decrease the temperature and pressure of the thermal control fluid, thereby allowing less heat to pass through the inner wall such that the temperature of the liquified gas within the chamber remains substantially the same.

* * * * *